US005768329A

United States Patent [19]

Berwald

[11] Patent Number: 5,768,329

[45] Date of Patent: Jun. 16, 1998

[54] APPARATUS FOR ACCELERATOR PRODUCTION OF TRITIUM

[75] Inventor: David Berwald, Centerport, N.Y.

[73] Assignee: Northrop Grumman Corporation, Los Angeles, Calif.

[21] Appl. No.: 594,324

[22] Filed: Jan. 30, 1996

[51] Int. Cl.[6] ..... G21G 1/10

[52] U.S. Cl. ..... 376/192; 376/195; 75/10.64; 95/245

[58] Field of Search ..... 376/190, 192–194, 376/146; 95/241, 245–247, 255; 75/10.64

[56] References Cited

U.S. PATENT DOCUMENTS

| | | | |
|---|---|---|---|
| 3,037,922 | 6/1962 | Johnson | 204/154.2 |
| 3,155,469 | 11/1964 | Lehmer et al. | 55/60 |
| 3,349,001 | 10/1967 | Stanton | 176/11 |
| 3,453,175 | 7/1969 | Hodge | 176/11 |
| 3,500,098 | 3/1970 | Fraser | 313/61 |
| 3,623,130 | 11/1971 | Dalrymple | 250/84.5 |
| 3,624,239 | 11/1971 | Fraas | 176/1 |
| 3,944,466 | 3/1976 | Marchese | 176/37 |
| 3,993,910 | 11/1976 | Parkin et al. | 250/499 |
| 4,344,911 | 8/1982 | Maniscalco et al. | 376/146 |
| 4,663,110 | 5/1987 | Cheng | 376/146 |
| 5,160,694 | 11/1992 | Steudtner | 376/146 |
| 5,160,696 | 11/1992 | Bowman | 376/189 |

OTHER PUBLICATIONS

Nuclear Europe, 8(11–12), (1988), pp. 42, 43, Perlado et al.

GRNL/TM-5750, (1977), pp. 1–48, Mynatt et al.

Proc. 4th Meeting of International Collaboration on Advanced Neutron Source, Oct. 1980, Japan, pp. 339–342, Article by Hoffman et al.

J. of Nuclear Materials, vol. 207, (1993), pp. 339–344, Tsuchiya et al (I).

Fusion Engineering and Design, vol. 14, No. 3 & 4, (Apr. 1991), pp. 353–372, Casini et al.

LA-UR-90-3096, (Sep. 1990), pp. 1–15, Wangler et al.

GA-A 17664, UC-20, (Sep. 1984), pp. 3–10, 35–38, 61–66.

Corrosion Problems in Nuclear Fusion Reators, V No. 1, (1989), Publisher; London Institute of Metals, Abstract of pp. 35–46, Coen.

LA-12004-C, (Mar. 1991), pp. 553–557, Lawrence.

Fusion Eng. and Design, vol. 14, No. 3 & 4, Apr. 1991, pp. 373–399, Malang et al.

J. of Nuclear Materials, vol. 207, (1993), pp. 123–129, Tsuchiya et al (II).

Fusion Eng. and Design, vol. 9, (1989), pp. 445–449, Sekimoto et al.

Fusion Eng. and Design, vol. 24, (1994), pp. 257–273, Merola et al.

Fusion Technology vol. 8, No. 1, Pt. 2A, (Jul. 1985), pp. 887–890, Sze.

Nuclear Technology/Fusion, vol. 4, No. 2, (Sep. 1983), pp. 407–411, Plute et al.

*Primary Examiner*—Harvey E. Behreno

*Attorney, Agent, or Firm*—Terry J. Anderson; Karl J. Hoch, Jr.

[57] ABSTRACT

Improved efficiency process for preparing or breeding tritium gas from dense molten lithium alloy by bombardment of the alloy as a target material using a linear accelerator emitting a high energy proton beam to generate a neutron flux. The invention involves using a dense eutectic molten lead lithium alloy as the target material, directing the impact area within the body of molten target material, such as to a depth of about 2 meters of the target material, and continuously circulating the molten alloy past the impact area to dissipate the heat of reaction to provide a substantial lead source for maximum neutron production and to provide an effective lithium source to absorb the neutrons, to produce the highest possible amount of tritium per proton applied by the high energy proton beam. The formed tritium gas is insoluble in and separates from the molten alloy.

3 Claims, 3 Drawing Sheets

APPARATUS FOR ACCELERATOR PRODUCTION OF TRITIUM

BACKGROUND OF THE INVENTION

1. Field of the Invention

The present invention relates to an improved process for the production of tritium in which a high energy proton flux from a high power radio frequency linear accelerator is directed against a lithium target material to generate tritium, and to a novel breeder apparatus for carrying out said process.

2. Status of the Art

The production or breeding of tritium by exposing lithium to a neutron flux in a nuclear reactor is well known in the art, and reference is made to the following prior art patents as exemplary of the status of the prior art.

U.S. Pat. Nos. 4,475,948 and 4,532,102 disclose methods and apparati for breeding and isolating tritium by irradiating lithium in a fission type nuclear reactor, the lithium materials comprising lithium aluminate particles and aqueous lithium sulfate, respectively. In the '948 process, the lithium salt must be embedded within a matrix of zirconium in pellet form, and zirconium hydride is formed as a by-product, requiring periodic reactor shut-down. In the '102 process a mixture of tritium and other lower hydrogen isotopes is produced, requiring heat distillation separation steps.

U.S. Pat. No. 3,957,597 discloses a process and nuclear fission apparatus for irradiating molten liquid metal to extract lithium tritide which is then mixed with a molten lithium salt and subjected to an oxidation or electrolytic step to extract and recover tritium gas.

U.S. Pat. No. 4,663,111 discloses a high temperature process and nuclear fission apparatus for producing tritium by exposing to a neutron flux solid lithium bismuth alloy having a melting point of 1145° C., in the presence of nickel which dissolves and retains the tritium, requiring a separation step to isolate the tritium from the nickel. This patent discloses the possible use of other high melting lithium alloys including a lithium lead alloy $Li_4Pb$ having a melting point of 726° C.

U.S. Pat. Nos. 2,868,987, 3,993,910 and 4,360,495 disclose processes and apparati in which target materials are continuously subjected to a high energy particle stream from an accelerator. In the '987 and '910 patents, the target material comprises a continuously-circulating molten liquid metal which provides a large renewable volume of target materials which carries away and dissipates the large amount of heat formed by the particle bombardment of the target. In the '910 patent the molten metal target material is lithium.

Pure molten lithium does not attenuate the incoming protons or trap and convert the formed neutrons into tritium very efficiently. Also tritium gas is fairly soluble in molten lithium and is difficult and costly to separate therefrom.

The use of lead lithium eutectic alloys is known for the formation of tritium in nuclear fusion reactors, and reference is made to a publication by J. D. Lee (editor), MINIMARS Conceptual Design: Final Report, UCID-20773, Lawrence Livermore National Laboratory, Sep. 30, 1986, as illustrative thereof.

All prior known processes and apparati for the accelerator production of tritium (APT) have substantial disadvantages with respect to efficiency, safety, performance, durability and complexity. They involve high temperature operation, exposure of coolants to radioactive materials, apparatus degradation, frequent shut down, low yield, isotope separation problems, complexity and dangerous operation conditions.

It is the object of the present invention to provide a novel APT process and apparatus which overcomes or avoids the aforementioned problems and dangers.

SUMMARY OF THE INVENTION

The present invention relates to a novel highly efficient APT process and apparatus for impacting relatively low-temperature molten lithium lead eutectic alloy LiPb as a circulating heavy metal target material, with a spallation neutron source. The molten eutectic provides a large volume of self cooling heat transfer material for continuous heat-dissipation, and an inexpensive pool of efficient tritium-breeder material which need not be removed from the apparatus over a prolonged duration of operation.

According to a preferred embodiment of the invention, a high energy proton beam from a linear accelerator is directed vertically downwardly into a reaction chamber against the surface of a convergent flow of molten lithium lead eutectic within the reaction chamber to attenuate the incoming protons and to convert the resulting neutrons and impacted lithium into tritium gas which is insoluble in and separates from the molten lithium lead alloy.

The lead lithium eutectic alloy is critically important for several reasons. First, because the molten lead lithium eutectic alloy target is fully dense with no voids, comprises 83 atomic weight percent lead, for maximum neutron production, and 17 atomic percent is lithium to absorb the neutrons, it has the highest tritium breeding ability of all known targets constructed from non-fissionable materials. Second, because there is no containment structure in the region of interaction between the proton beam and the lead lithium fluid, proton and neutron irradiation damage is eliminated, providing for increased operating lifetime for the internal components of the tritium breeding target apparatus. Third, because the heat from the beam is deposited directly into the fluid, heat transfer issues are avoided. Fourth, because tritium is insoluble in the lead lithium, tritium extraction with low in situ tritium inventory is eased. Fifth, structural activation is minimized and because the lead lithium is incapable of a strong exothermic reaction when exposed to air or water, a high level of intrinsic safety is insured. Sixth, because the lead lithium is not depleted or otherwise damaged and because structure activation is minimized, the discharge of radiotoxic waste streams is minimized.

DETAILED DESCRIPTION

Figure 1:
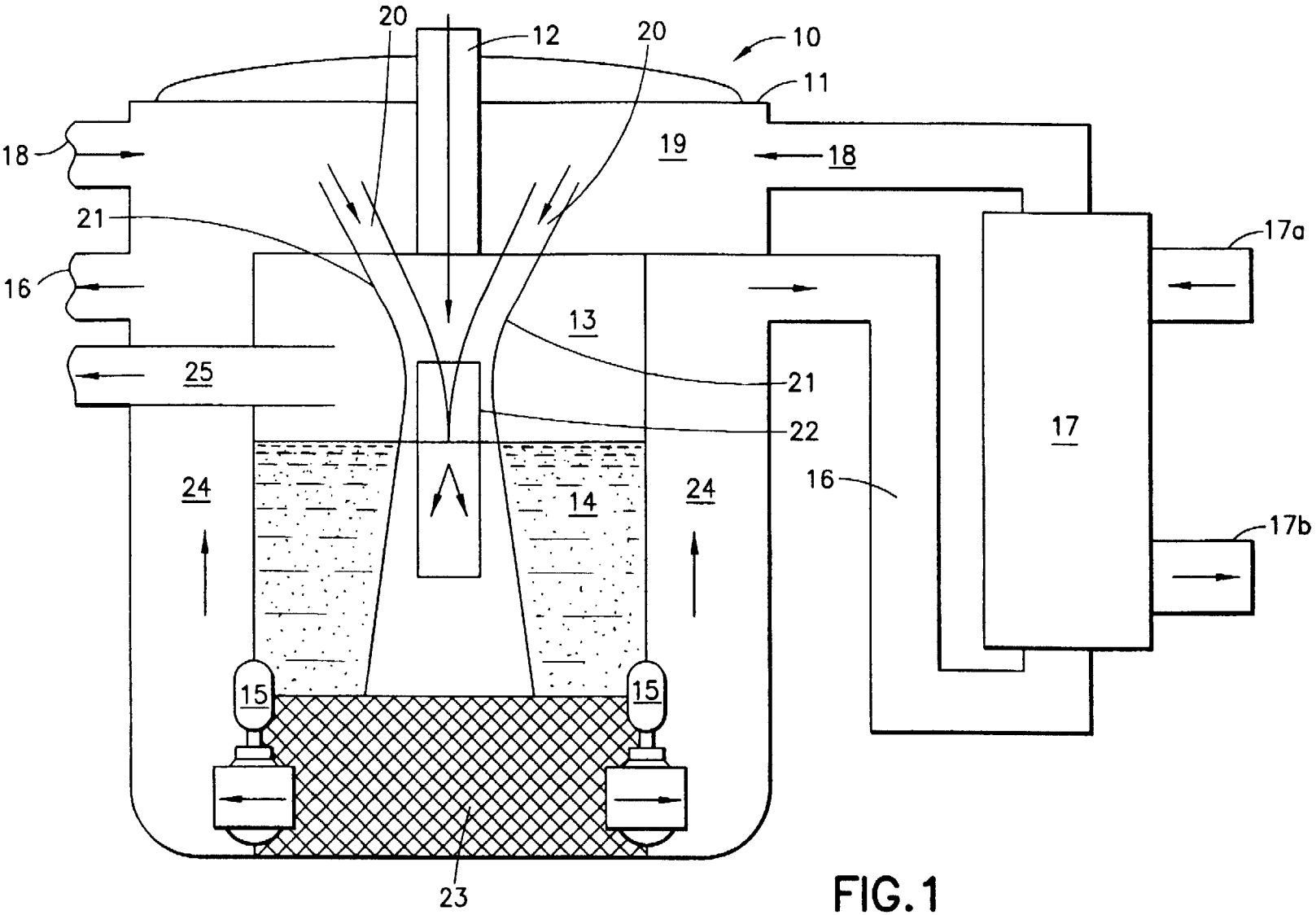
FIG. 1 is a diagrammatic cross-section of a tritium breeding accelerator apparatus according to a preferred embodiment of the present invention.

Referring to FIG. 1, the APT apparatus 10 thereof comprises a radiation-resistant housing 11, such as of ferritic steel, a high energy proton flux beam accelerator tube 12 supported in vertical extension through the housing 11 and opening into the reaction chamber 13 containing a substantial supply 14 of molten lithium lead alloy having a melting point of 236° C. and consisting of 83 atomic % lead and 17 atomic % lithium.

The apparatus 10 comprises pumps 15 for circulating the molten metal 14 through inlet conduits 16, through a heat exchanger 17 and out through return flow conduits 18 and the top 19 of the apparatus for gravity return to the main lead lithium supply through downwardly and inwardly inclined return conduits 20 or conical funnel which direct and return flow of the cooled molten lead lithium eutectic in the form of a converging flow or waterfall 21 having a maximum continuous downward flow in converging impact region 22, extending beneath the surface of the bulk supply 14 of the lead lithium liquid alloy.

The bombardment of the circulating lead lithium target alloy at a centralized location within the mass volume of the alloy attenuates, focuses and envelopes the high energy proton beam, and the formed neutrons, within the bulk molten target alloy, and the lead component of the eutectic produces neutron multiplication which enhances the efficiency of the reaction. Also the high density lead component, which constitutes 83 atomic % of the eutectic, provides a protective barrier which concentrates the protons and neutrons at the impact area and retards the diffusion and escape thereof.

The APT reaction generates substantial localized heat in the impact area or converging region 22 of the target alloy. However, the molten alloy comprises a heat sink, and its continuous circulation through the region 22, down through a conventional downstream steel flow diffuser 23, which mitigates against the persistence of hot spots in the lead lithium flow, and through opposed heat exchangers 17 before re-entry to the converging region 22, provides a continuous removal of the heat of reaction from the target area and a continuous cooling of the target material to provide continuous self-cooling operation over a prolonged period of time.

The continuous circulation of the lead lithium alloy is accomplished by pumps 15 which draw the heated alloy through the steel flow diffuser 23, of approximately 50% relatively inert ferritic steel, and pump it up through a peripheral circulation chamber 24 into inlet conduits 16, through heat exchangers 17 and out return flow conducts 18 into a top supply chamber 19 of the housing 11 in cooled condition. The cooled target alloy flows by gravity through inclined conduits 20 in the form of a converging flow 21 of the cooled eutectic which re-enters the impact region 22. The amount of lithium in the bulk eutectic target material far exceeds the amount of tritium to be produced so that it is not significantly reduced even over a prolong duration of continuous operation. The lead lithium eutectic alloy is not significantly consumed by the process and is not subject to irradiation damage.

The heat exchangers 17 are of conventional coolant circulation design, having a coolant inlet 17*a* and a coolant outlet for continuously circulating a coolant, such as water or other heat transfer fluid, through interior piping such as a cooling coil within each heat exchanger 17 to withdraw heat from the lead lithium eutectic alloy and reduce its temperature, such as to less than about 450° C.

Figure 2:
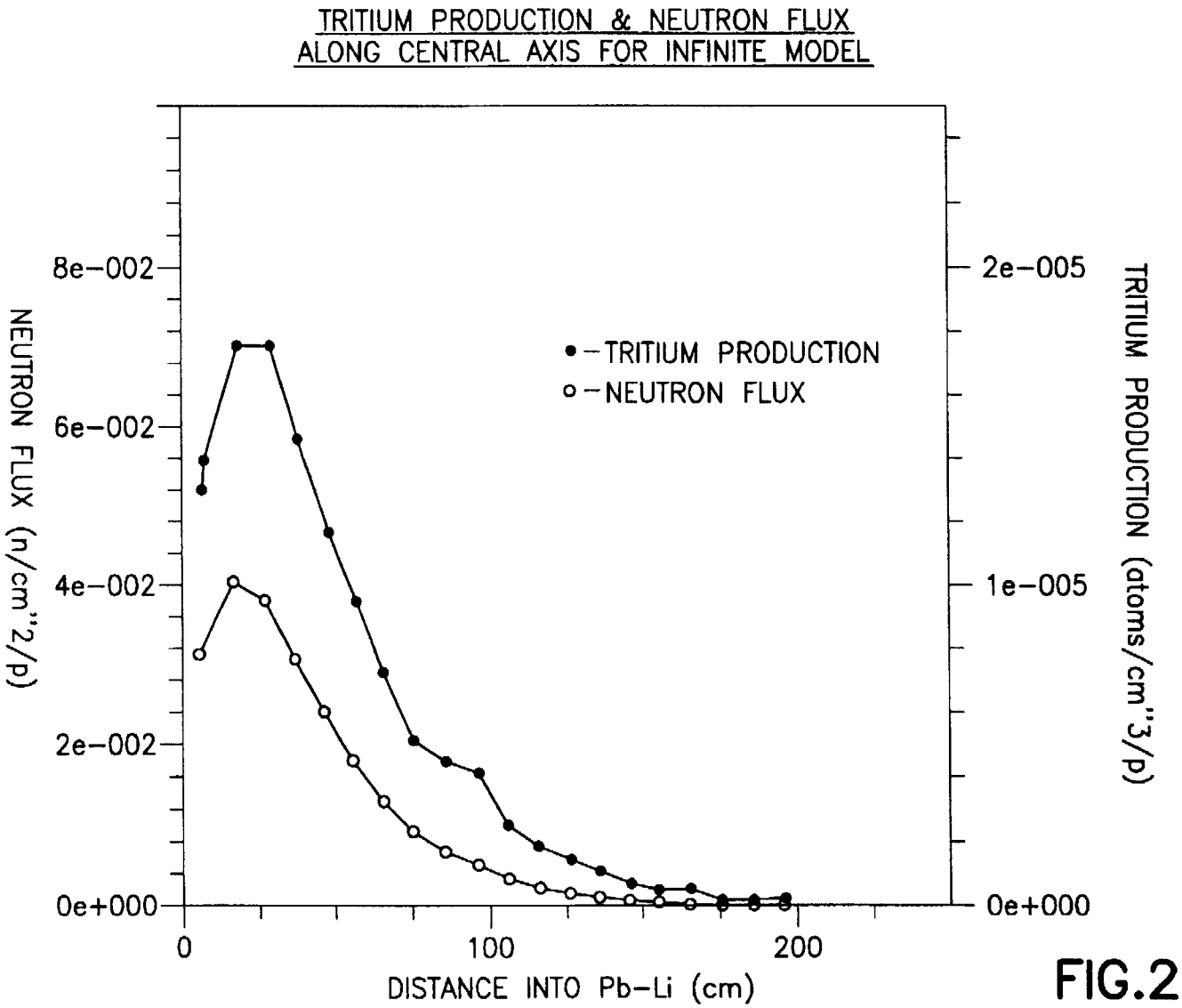
FIG. 2 is a graphic illustration of the relationship between the strength of the neutron flux, the penetration distance of the flux into the lithium lead molten alloy and the tritium production.

As illustrated by FIG. 2 of the drawings, the degree of tritium production corresponds to the neutron flux intensity, and both drop off quickly as the distance from the high energy beam increases within the molten metal 14. Thus maximum flux intensity and tritium production occurs within the impact region 22 of FIG. 1 at a depth of about 10 inches of the lead-lithium eutectic molten metal in all directions. Flux intensity and tritium production cease at a distance of about 2 meters from the high energy beam within the molten metal 14.

The neutron flux and tritium production shown in FIG. 2 are on a per proton basis. If the proton current is 100 mA (0.1 A), then the proton flux is $6.25 \cdot 10^{17}$ protons/s. In this case, the peak value on the graph is 0.08 of this, or $5.0 \cdot 10^{16}$. Similarly, the tritium production corresponding to $2 \cdot 10^{-5}$ tritium atoms/cm$^3$/p is $1.25 \cdot 10^{13}$ tritium atoms/cm$^3$/p. For a 100 mA, 1000 MeV beam, the total production is about 31 tritium/p, or $1.9 \cdot 10^{19}$ tritium atoms/s. This corresponds to $6.0 \cdot 10^{26}$ tritium/yr, or 3 kg/yr.

The formed tritium gas is substantially insoluble in the molten alloy 14 and continuously bubbles up to chamber 13 from which it is withdrawn through vacuum conduit 25 for isolation.

Figure 3:
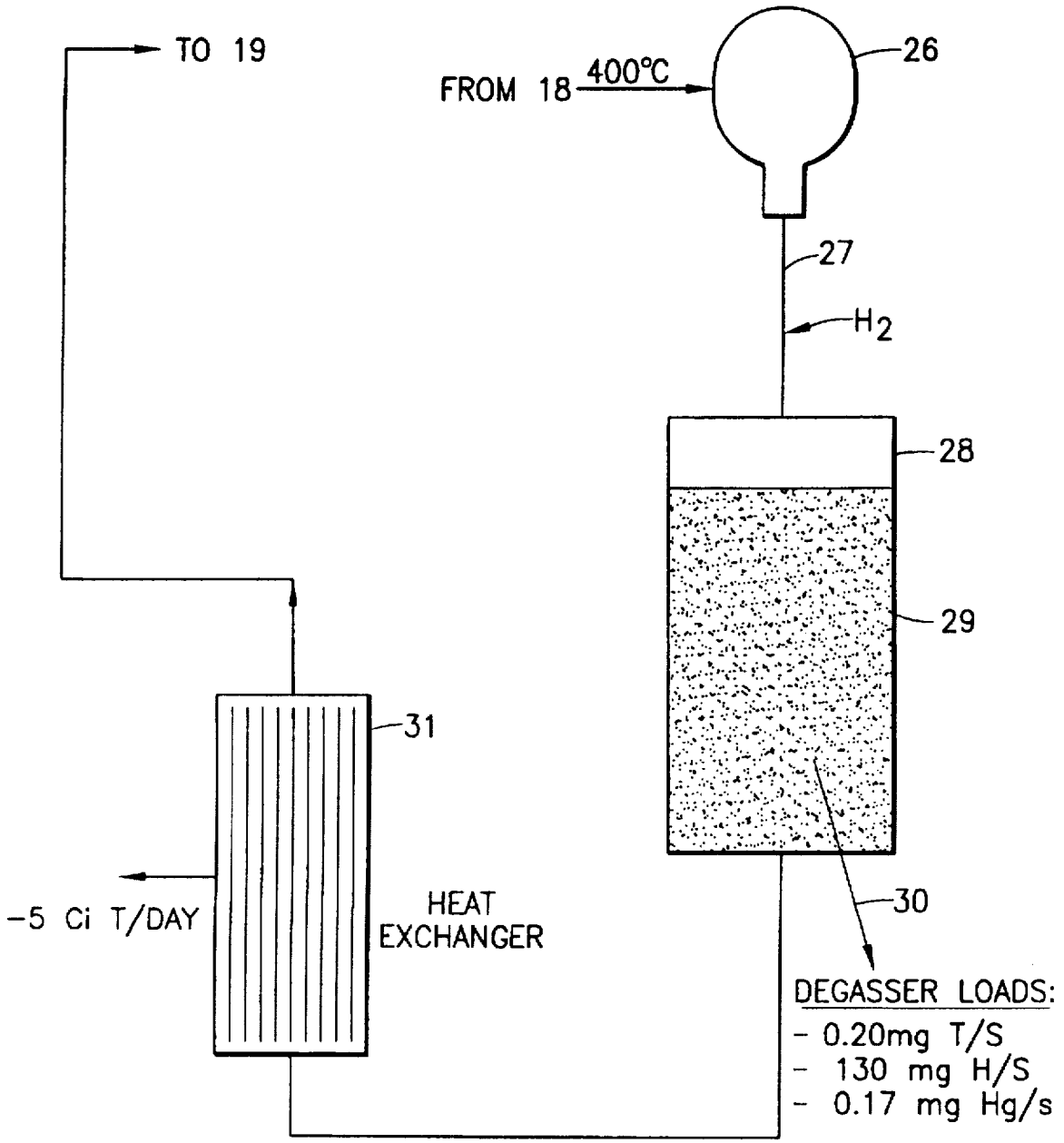
FIG. 3 illustrates a tritium gas-removal or separation apparatus suitable for use in association with the APT apparatus of FIG. 1.

The apparatus of FIG. 3 illustrates a tritium removal or separation apparatus for use in association with the apparatus of FIG. 1 to remove the formed tritium by on-line sparging with hydrogen or helium. Hydrogen, for example, has a very low solubility equilibrium in the lead-lithium eutectic. Thus by diluting the tritium within the about 2000 parts of hydrogen per part of tritium, and extracting the hydrogen/tritium gas droplets by vacuum pumping, the residue of remaining tritium in the lead lithium can be reduced to about 0.03 gram of tritium.

As illustrated by FIG. 3, the molten alloy is withdrawn from return flow conduit 18 through pump 26 and is pumped through a hydrogen sparging conduit 27 into a droplet generator 28 and vacuum degasser 29 from which tritium gas and hydrogen gas are extracted by vacuum pumping through extraction conduit 30. The eutectic alloy is recirculated through a heat exchanger 31, which may be the same as heat exchanger 17 of FIG. 1, back into the top supply chamber 19 of the APT apparatus 10.

It will be apparent to those skilled in the art that the essential novelty of the present invention resides in the use of a relatively low temperature lead lithium eutectic alloy, which provides six important advantages. First, because the molten lead lithium eutectic alloy target is fully dense with no voids, comprises 83 atomic weight percent lead, for maximum neutron production, and 17 atomic percent is lithium to absorb the neutrons, it has the highest tritium breeding ability of all known targets constructed from non-fissionable materials. Second, because there is no containment structure in the region of interaction between the proton beam and the lead lithium fluid, proton and neutron irradiation damage is eliminated, providing for increased operating lifetime for the internal components of the tritium breeding target apparatus. Third, because the heat from the beam is deposited directly into the fluid, heat transfer issues are avoided. Fourth, because tritium is insoluble in the lead lithium, tritium extraction with low in situ tritium inventory is eased. Fifth, structural activation is minimized and because the lead lithium is incapable of a strong exothermic reaction when exposed to air or water, a high level of intrinsic safety is insured. Sixth, because the lead lithium is not depleted or otherwise damaged and because structural activation is minimized, the discharge of radiotoxic waste streams is minimized.

It will also be apparent that the vapor pressure of the present lead lithium molten alloy is substantially less than the beam operating requirement of about $10^{-6}$ torr so that the requirement for a water-cooled Inconel window in the beam path may be eliminated. Also, the self-cooling of the alloy avoids high heat flux issues and complex insulating reactor wall structures.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. An accelerator apparatus for breeding tritium by impacting a proton beam against molten eutectic lead lithium alloy target material, comprising a ferritic steel housing enclosing a reaction chamber having a lower reservoir section containing a supply of molten eutectic lead lithium alloy target material comprising 83 atomic % lead and 17 atomic % lithium, and an upper airspace section overlying said molten alloy, means for maintaining a vacuum pressure in said upper airspace section, a proton flux accelerator tube extending vertically through said housing into said airspace for directing a proton flux beam into said lower reservoir section, and means for continuously circulating said molten target material through said airspace section as a downwardly-converging continuous flow to converge at the point of impact with said proton flux beam within said lead lithium alloy, in the absence of any containment structure for said flow, other than the supply of molten alloy within said reservoir, to produce tritium, and through a heat exchanger to cool the molten target material, and back up through said airspace section for recirculation.

2. An apparatus according to claim 1 further comprising a diffusion means downstream of said point of impact and upstream of said airspace section to assist the separation of the formed tritium gas.

3. An apparatus according to claim 1 further comprising a gas sparging means for diluting the formed tritium gas with hydrogen, and vacuum degasser means for extracting hydrogen/tritium gas droplets from the eutectic.

* * * * *